US005986200A

United States Patent [19]

Curtin

[11] Patent Number: 5,986,200

[45] Date of Patent: Nov. 16, 1999

[54] SOLID STATE INTERACTIVE MUSIC PLAYBACK DEVICE

[75] Inventor: Steven DeArmond Curtin, Freehold, N.J.

[73] Assignee: Lucent Technologies Inc., Murray Hill, N.J.

[21] Appl. No.: 08/990,868

[22] Filed: Dec. 15, 1997

[51] Int. Cl.[6] ..... A63H 5/00; G04B 13/00; G10H 7/00

[52] U.S. Cl. ..... 84/609; 434/307 A

[58] Field of Search ..... 84/609, 619, 612, 84/634, 636; 434/307 A

[56] References Cited

U.S. PATENT DOCUMENTS

| | | | |
|---|---|---|---|
| 5,296,643 | 3/1994 | Kuo et al. | 434/307 A |
| 5,494,443 | 2/1996 | Nakai et al. | 84/609 X |
| 5,511,053 | 4/1996 | Jae-Chang | 84/612 X |
| 5,703,308 | 12/1997 | Tashiro et al. . | |
| 5,750,912 | 5/1998 | Matsumoto | 84/609 |
| 5,753,843 | 5/1998 | Fay . | |
| 5,777,252 | 7/1998 | Tada | 84/609 |
| 5,808,224 | 9/1998 | Kato | 84/609 |
| 5,811,707 | 9/1998 | Kakehashi et al. | 84/609 X |

OTHER PUBLICATIONS

S. Wilkinson, "General MIDI," Electronic Musician, pp. 120–124, Nov. 1997.

C. Dodge and T.A. Jerse, "Computer Music: Synthesis, Composition and Performance," pp. 226–237 and pp. 265–293, Schirmer Books, New York, 1985.

*Primary Examiner*—Jeffrey Donels

[57] ABSTRACT

An interactive music playback device includes a sequencer for processing audio information corresponding to a song or other selected piece of music. The audio information may be retrieved from a PCMCIA card or other suitable solid state data storage cartridge which is inserted in a slot in the playback device. The sequencer arranges the audio information in a playback sequence based on one or more user-specified playback parameters, such as tempo, key and playback duration. Voice and instrument synthesizers receive the playback sequence and generate therefrom respective vocal and instrumental portions of the selected piece of music. The playback device may operate in a verse-shuffle mode of operation, in which the sequencer arranges the playback sequence to include randomly-selected verses of the selected piece of music interspersed with a chorus of the selected piece of music. The parameters of the playback sequence may also be varied in accordance with measures of external conditions as received from one or more environmental sensors. The playback device may also include a network connection for use in downloading the audio information from a network to the playback device.

36 Claims, 2 Drawing Sheets

SOLID STATE INTERACTIVE MUSIC PLAYBACK DEVICE

FIELD OF THE INVENTION

The present invention relates generally to devices for playing back stored or downloaded musical selections and more particularly to an interactive music playback device which allows a user to specify various playback parameters.

BACKGROUND OF THE INVENTION

Conventional playback devices, such as compact disk (CD) players and cassette tape machines, generally play a given recorded piece of music in substantially the same way every time, with fixed playback parameters such as tempo and playback duration. These and other playback devices are typically very limited in terms of user-specified playback parameters. For example, although conventional playback devices allow a user to select playback of a particular song, and to control output characteristics such as volume, base, treble and speaker balance, the devices generally do not allow the user to vary tempo, playback duration or other playback parameters for the selected song. Furthermore, although certain types of conventional CD players allow a user to select random playback of entire songs selected from one or more CDs, current CD technology does not permit sufficiently rapid switching of information to allow, for example, random selection of different user-specified portions of particular songs. Conventional playback devices are thus limited to playback of entire recorded songs with fixed tempo and playback duration.

Another significant problem with conventional playback devices is that the storage and playback mechanisms used in such devices are relatively delicate and prone to breakage. For example, both CD players and cassette tape machines include delicate drive mechanisms with moving parts such as motors, belts and wheels, which have a tendency to break down. This tendency is even more apparent in portable and mobile units. Although certain playback devices, such as the Sony Walkman™ and Discman™ products and automobile stereo systems, are specifically designed for playback in portable or mobile applications, the moving parts required in the CD or tape drives of these devices remain unduly susceptible to breakdown. Moreover, the delicate drive mechanisms often cause the playback audio output to skip or warble in reaction to road bumps, footsteps or other disturbances, resulting in an unpleasant listening experience for the user.

As is apparent from the above, there is a need for an improved playback device which can allow user selection of playback parameters such as tempo and playback duration, while substantially eliminating the frequent breakdowns, skipping and other problems typically associated with conventional devices.

SUMMARY OF THE INVENTION

The invention provides an interactive playback device which allows a user to specify playback parameters such as tempo, key and length of playback for a given song or other piece of music. In an illustrative embodiment of the invention, an interactive music playback device includes a sequencer for processing audio information corresponding to a selected piece of music. The sequencer arranges the audio information in a playback sequence based on one or more of the above-noted user-specified playback parameters. Voice and instrument synthesizers then receive the playback sequence and generate therefrom respective vocal and instrumental portions of the selected piece of music.

The playback device may operate in a verse-shuffle mode of operation, in which the sequencer arranges the playback sequence to include randomly-selected verses of the selected piece of music interspersed with a chorus of the selected piece of music. The parameters of the playback sequence may also be varied in accordance with measures of external conditions as received from one or more environmental sensors. For example, in a portable unit for use in jogging or other recreation applications, the tempo or other playback parameter could be varied based on a measurement from a heart rate monitor attached to the user. In an automotive application, the tempo or other playback parameter could be varied based on speed or acceleration.

The audio information processed by the playback device may be retrieved from a PCMCIA card or other suitable solid state data storage cartridge which is inserted in a slot in the playback device. The audio information may alternatively downloaded from the Internet or another network via a network connection in the playback device, and then either played back directly or stored for subsequent playback.

Unlike conventional playback devices, a playback device in accordance with the invention is able to play back selected portions of a given piece of music in a particular sequence and for as long as a user wishes. Because it can be configured to utilize a solid state memory in place of a conventional CD or tape drive, a playback device in accordance with the invention is substantially less susceptible to breakdown, and its audio output will not skip or warble in response to external disturbances. The invention is therefore particularly well suited for use in portable units, automotive applications, and other applications in which bumps or similar disturbances cause audible skipping or warbling in conventional drive mechanisms.

DETAILED DESCRIPTION OF THE INVENTION

The invention will be illustrated below in conjunction with exemplary music playback devices. It should be understood, however, that the invention is more generally applicable to any device or application in which it is desirable to play back stored musical information in an interactive manner. Although particularly well suited for use in portable music players, the invention may be used in any type of audio playback device, including, for example, home or automotive stereo equipment, professional recording, mixing or broadcasting equipment, desktop and portable personal computers, computer sound cards, music synthesizers, karioke machines and other audio information processing equipment. The term "piece of music" as used herein should be understood to include a song, single or other musical arrangement, and may correspond, for example, to a "track" on a conventional CD or cassette tape.

Figure 1:
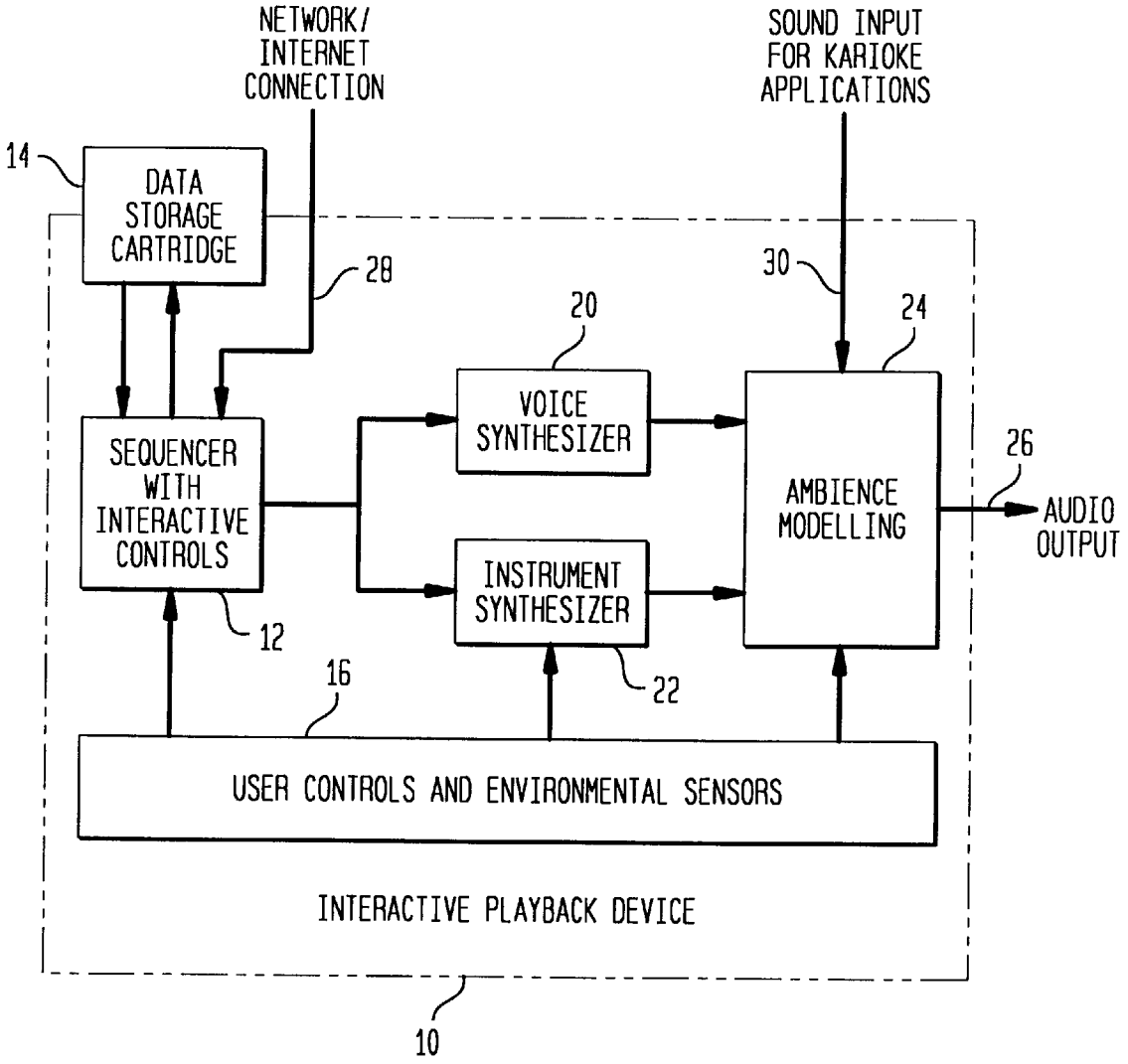
FIG. 1 is a functional block diagram of an interactive playback device in accordance with an exemplary embodiment of the invention.

FIG. 1 is a functional block diagram illustrating the operation of an interactive playback device 10 in accordance with one possible embodiment of the invention. The interactive playback device 10 in this embodiment includes a sequencer 12 with interactive controls, a data storage cartridge 14 and a set 16 of user controls and environmental sensors. The output of sequencer 12 is coupled to inputs of a voice synthesizer 20 and an instrument synthesizer 22. The data storage cartridge 14 may be a Personal Computer Memory Card Interface Adaptor (PCMCIA) card or other suitable cartridge. The cartridge 14 may include a Flash memory or other type of memory suitable for storing music or other audio information in accordance with a "structured audio" file format such as MPEG-4. The MPEG-4 structured audio format is described in ISO/IEC 14496.3, "Information Technology—Coding of Audiovisual Objects, Part 3: Audio, Subpart 5: Structured Audio," CD 0.1, October 1997, which is incorporated by reference herein. Additional information on MPEG-4 may be found at http://sound.media.mit.edu/~eds/mpeg4. Other types of structured audio formats suitable for use with the invention include Rich Music Format (RMF), a proprietary format of Headspace, http://www.headspace.com.

Structured audio permits very high data compression of music since only the gestural characteristics of the music, such as notes and vibrato, are stored. The audio information stored in data storage cartridge 14 may thus be configured so as to provide voice and instrumentation information for a given piece of music. For example, the stored audio information may include gesture files such as Score/Note/Performance files and Samples/Instruments files. This information, in contrast to the audio sample stream information typically stored on a conventional CD, allows the voice synthesizer 20 and instrument synthesizer 22 to render the respective score and instrument output in real time. The voice synthesizer 20 should have sufficient fidelity to recreate the sounds of a wide range of vocals without introducing distracting artifacts. The instrument synthesizer 22 may be, for example, a synthesizer based on the musical instrument digital interface (MDI) standard. MIDI is described in greater detail in, for example, S. Wilkinson, "General MDI," Electronic Musician, pp. 120–124, November 1997, which is incorporated by reference herein. In alternative embodiments, the voice and instrument synthesizers 20, 22 may be combined into a single synthesizer.

In operation, the sequencer 12 delivers audio information retrieved from the data storage cartridge 14 to the voice and instrument synthesizers 20 and 22. The audio information is retrieved and delivered by the sequencer 12 in accordance with user-specified playback parameters and/or output of environmental sensors in the set 16. For example, a user may specify playback parameters such as tempo, key, tempo beat map, playback duration, shuffle repeat modes and so on using the user controls, and the sequencer will deliver the stored audio information to the synthesizers 20 and 22 such that it is played back in accordance with the user-specified parameters. It should be noted that the sequencer 12 could be implemented in a number of different ways. For example, the sequencer 12 may be implemented as a fixed score reader, an algorithmic music generator which creates music based on rules and procedures, or a combination of a fixed score reader and an algorithmic music generator. In the latter case, the sequencer 12 may operate as a music generator with a predefined control score whose high-level characteristics are modifiable by the user. The term "sequencer" as used herein should be understood to include these and other alternative implementations.

In the exemplary embodiment of FIG. 1, the tempo, key, tempo beat map, playback duration and other parameters of the playback could be tied to values delivered by the environmental sensors. For example, in a portable playback device suitable for use in conjunction with recreational activities such as jogging, the environmental sensors may monitor heart rate or other user characteristics, such that the tempo, key or other music playback parameters vary in accordance with the monitored characteristic. In a playback device incorporated into an automobile stereo system, the environmental sensors may measure driving parameters such as speed or acceleration, with the sequencer 12 delivering the retrieved audio information in accordance with the measured speed or acceleration. Other music playback parameters which may be altered in accordance with user-specified input in playback device 10 include, for example, "feel factors" such as indications of constrained random variations in timing of a note based on placement of that note in a bar.

One repeat mode supported by the interactive playback device 10 is referred to herein as a random verse-shuffle mode. In this mode, a user selects a song or other piece of music for playback, and the selected piece of music includes a number of verses and at least one chorus. The sequencer 12 operates to randomly pick verses of the selected piece of music selection for playback, with the corresponding chorus repeated before or after each verse. The random selection of verses can continue for a pre-specified period, or for as long as the user selection remains the same. The verse shuffle mode of operation as well as the capability for specifying a playback period can allow a given song or other piece of music to be programmed for a playback of indefinite length. This provides considerably more user listening options than the required fixed length playback generally associated with conventional playback devices.

The interactive playback device 10 further includes an ambience modelling element 24 which receives the voice and instrument outputs from the respective voice and instrument synthesizers 20 and 22. The modelling element 24 combines the voice and instrument outputs to generate an audio output signal at output 26. The modelling element 24 alters the combination of the voice and instrument outputs in accordance with information received from the set 16 of user controls and environmental sensors, such that the audio output incorporates information regarding current specified or measured ambient conditions. The functions implemented in modelling element 24 may be based on well-known reverberation techniques, such as those described in, for example, J. A. Moorer, "About This Reverberation Business," Computer Music Journal, 3(2):13–28, 1979; M. R. Schroeder, "Improved Quasi-Stereophony and Colorless Artificial Reverberation," Journal of the Acoustical Society of America, 33:1061–64, 1961, M. R. Schroeder, "Natural Sounding Artificial Reverberation," Journal of the Acoustical Society of America, 10(3):219–23, 1962, and M. R. Schroeder and B. F. Logan, "Colorless Artificial Reverberation," Journal of the Audio Engineering Society, 9(3):192–97, 1961, all of which are incorporated by reference herein.

The sequencer 12 may also receive input audio data from a network connection 28. The network connection 28 may be used to provide a connection to the Internet or to any other external network, including a local area network, wide area network, or telephone, cable or satellite network. The sequencer 12 can therefore download audio information directly from a modem or other device using the network connection 28. The downloaded audio information may be played by the interactive playback device 10 in accordance with user-specified parameters using sequencer 12 and synthesizers 20, 22 in a manner similar to that previously described. Alternatively, the downloaded audio information could be stored by the sequencer 12 on the data storage cartridge 14 for later playback. The interactive playback device 10 can thus be used to download a current favorite song from the Internet as a single, without requiring the user to download or purchase an entire CD. Moreover, the playback device 10 eliminates the need to reduce the audio information to an 11 kHz sampling rate prior to downloading, which is generally required when using conventional techniques for downloading music from the Internet. The above-described structured audio format is sufficiently compact to allow music to be downloaded directly from the Internet without reformatting and without loss of fidelity.

The interactive playback device 10 further includes an external sound input 30 which may be used, for example, in karioke applications. In such an application, a microphone may be connected to the sound input 30, such that external vocals or other sounds are combined in modelling element 24 with the outputs of voice and instrument synthesizers 20, 22. The resulting audio signal at output 26 will then include the externally-supplied vocals. The output of voice synthesizer 20 may be disabled when the playback device 10 is operating in a karioke application, such that only the external vocals are combined with the instrumentation from instrument synthesizer 22.

Figure 2:
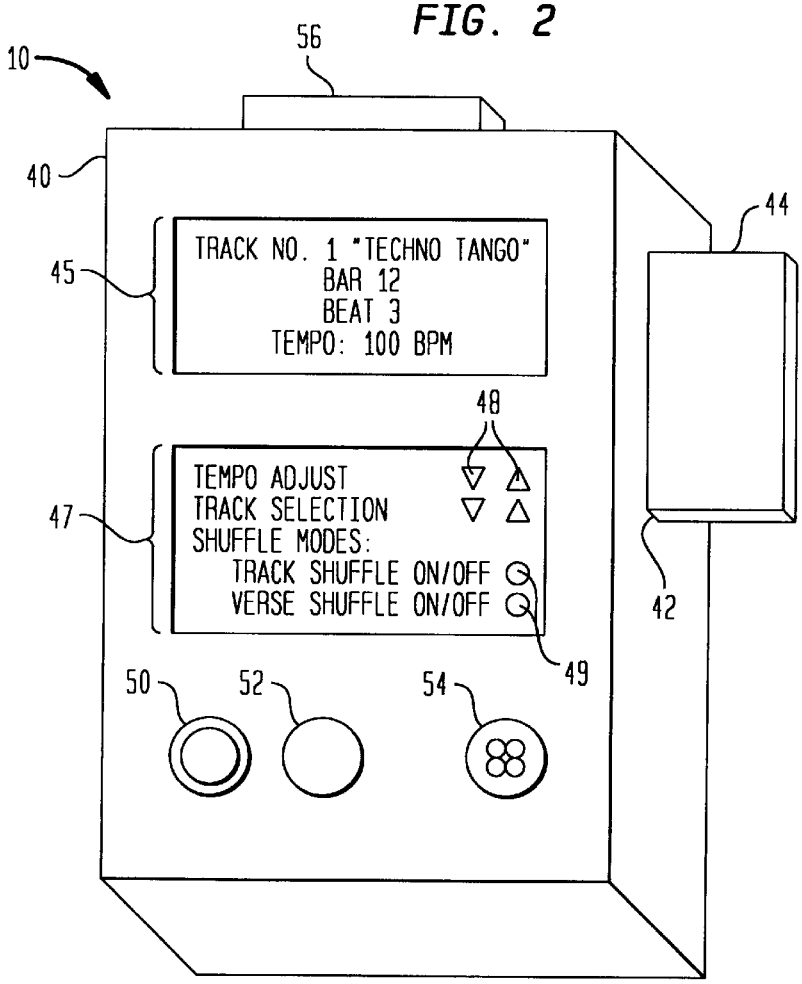
FIG. 2 illustrates one possible external configuration of an exemplary portable interactive playback device in accordance with the invention.

FIG. 2 shows one possible external configuration of the interactive playback device 10. The playback device 10 in this embodiment includes a housing 40 with a PCMCIA slot 42 for accepting a PCMCIA card 44. The device 10 further includes a status display 45, and a set of user controls 47. The status display 45 indicates a number and title of a currently-selected track, e.g., "Track No. 1 'Techno Tango."' The track corresponds generally to a particular song or other piece of music available on the PCMCIA card 44 or via download from a network connection. The status display 45 in this embodiment also provides an indication of the selected tempo, e.g., 100 beats per minute (BPM), the selected key, e.g., "Bar 12," and the selected tempo beat map, e.g., "Beat 3." These and other playback parameters are selected by the user in the manner previously described in conjunction with FIG. 1.

The user makes the selections by manipulating up and down arrows 48, buttons 49 or other suitable selection mechanisms in the set of user controls 47. The set of controls in this exemplary embodiment include a first set of up and down arrows 48 for adjusting tempo, a second set of up and down arrows for selecting tracks, and on/off buttons 49 for turning on and off track-shuffle and verse-shuffle modes. Of course, numerous other configurations of buttons, knobs, switches and/or other selection mechanisms could be used in other embodiments. The interactive playback device 10 also includes an output jack 50 which may be used for connecting device 10 to a set of headphones or another type of external speaker system. A volume control 52 is used to adjust the volume of the output audio signal. A network connection jack 54 is used to make a connection between playback device 10 and an external network as described in conjunction with connection 28 of FIG. 1. A support clip 56 is used to support the playback device 10 on a belt, shoulder strap, pocket or the like of a user. The embodiment of interactive playback device 10 shown in FIG. 2 is well suited for use injogging, sports and other portable device applications. It should again be noted that the invention does not require any particular type of external configuration, and could be implemented in a wide variety of portable or fixed audio playback equipment.

Figure 3:
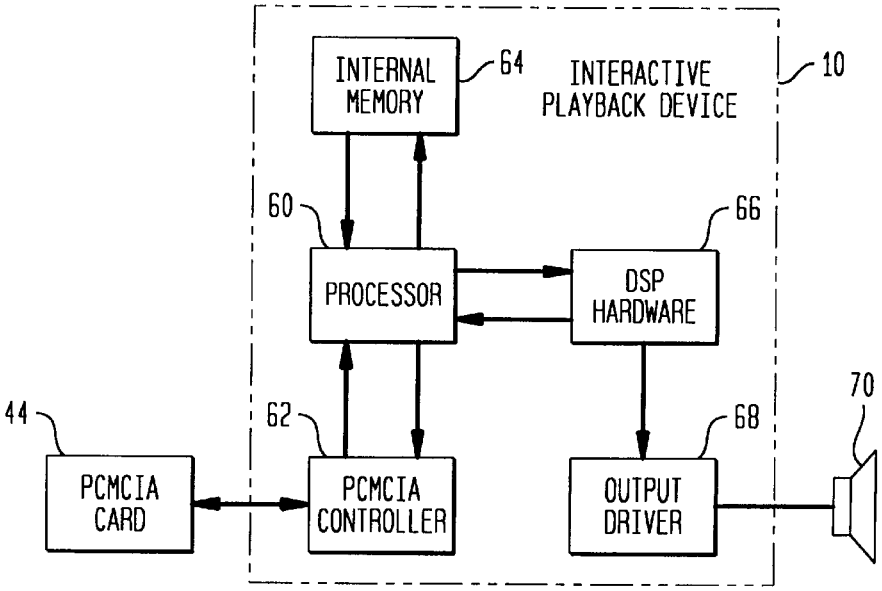
FIG. 3 is a hardware-oriented block diagram of an interactive playback device in accordance with an exemplary embodiment of the invention.

FIG. 3 shows a hardware-oriented block diagram of an interactive playback device 10 in accordance with the invention. The functional elements of the device 10 as described in conjunction with FIG. 1 above may be implemented using the arrangement of hardware elements shown in FIG. 3. The playback device 10 as shown in FIG. 3 includes a processor 60, a PCMCIA controller 62, an internal memory 64, digital signal processing (DSP) hardware 66, and an output driver 68. The PCMCIA controller 62 interfaces with the PCMCIA card 44 and is operative to transfer data between the card 44 and the processor 60 in a well-known manner. The processor 60 may be a microprocessor, an application-specific integrated circuit (ASIC), or other suitable digital data processor. The internal memory 64 may be a random-access memory (RAM) or other suitable memory device, and may be incorporated into the processor 60. The processor 60 operates in accordance with program instructions or other processing information stored in internal memory 64 to carry out the playback functions described in conjunction with the functional block diagram of FIG. 1. For example, the processor 60 may implement the functions provided by the sequencer 12 of FIG. 1.

The DSP hardware 66 may implement the functions of the voice synthesizer 20, the instrument synthesizer 22, and the ambience modelling element 24 of FIG. 1. The processor 60 receives user selection information and environmental sensor information, and delivers voice and instrumental information retrieved from PCMCIA card 44 to the DSP hardware 66. The DSP hardware synthesizes the voice and instrumental parts of the retrieved information in a manner controlled by the processor 60, and supplies an audio signal to the output driver 68. The driver 68 supplies the audio signal to a speaker 70 which may be part of a set of headphones or a more sophisticated speaker system. The interactive playback device 10 may include other elements not shown in FIG. 3, such as one or more display drivers for implementing the status display 45 of FIG. 2, and a read-only memory (ROM) for implementing control functions associated with the set of user controls 47.

The above-described embodiments of the invention are intended to be illustrative only. Alternative embodiments may use other types and arrangements of processing elements to implement the sequencing, synthesizing and modelling operations. For example, the verse-shuffle mode of operation could be implemented using memory devices other than a data storage cartridge or a PCMCIA card. One possible embodiment could provide the verse-shuffle mode of operation in, for example, a high-speed digital versatile disk (DVD) player. Other embodiments could implement one or more of the interactive playback features described above in an otherwise conventional CD player, radio, cassette tape player, automobile stereo or other known audio processing device. These and numerous other alternative embodiments within the scope of the following claims will be apparent to those skilled in the art.

What is claimed is:

1. An interactive music playback device comprising:

a sequencer for processing audio information corresponding to a selected piece of music, wherein the audio information is in a structured audio format including one or more gesture files, and the sequencer arranges the audio information in a playback sequence in accordance with at least one user-specified playback parameter;

a voice synthesizer having an input for receiving at least a portion of the sequence of audio information from the sequencer, wherein the voice synthesizer processes the received portion of the sequence to generate a vocal portion of the selected piece of music; and an instrument synthesizer having an input for receiving at least a portion of the sequence of audio information from the sequencer, wherein the instrument synthesizer processes the received portion of the sequence to generate an instrumental portion of the selected piece of music.

2. The playback device of claim 1 wherein the user-specified playback parameter is a tempo for the selected piece of music.

3. The playback device of claim 1 wherein the user-specified playback parameter is a key for the selected piece of music.

4. The playback device of claim 1 wherein the user-specified playback parameter is a playback duration for the selected piece of music.

5. The playback device of claim 1 wherein the user-specified playback parameter is a verse-shuffle mode of operation for the selected piece of music, in which the sequencer repeatedly randomly selects a verse from a plurality of verses of the selected piece of music for playback with a chorus of the selected piece of music.

6. The playback device of claim 1 wherein the audio information is retrieved from a solid state data storage device.

7. The playback device of claim 6 wherein the data storage device is a data storage cartridge, and the playback device further includes a slot for accepting the data storage cartridge.

8. The playback device of claim 7 wherein the data storage cartridge is a PCMCIA card.

9. The playback device of claim 1 further including at least one environmental sensor having an output coupled to at least one of the sequencer and the instrument synthesizer, wherein a characteristic of the playback sequence is varied based on a measure generated by the environmental sensor.

10. The playback device of claim 1 further including a network connection for downloading the audio information from an external network to the playback device.

11. An interactive music playback device comprising:

a processor operative (i) to retrieve audio information corresponding to a selected piece of music, wherein the audio information is stored in a structured audio format including one or more gesture files, and (ii) to arrange the audio information in a playback sequence in accordance with at least one user-specified playback parameter; and a digital signal processing device coupled to the processor, the digital signal processing device receiving at least a portion of the sequence of audio information from the sequencer, and synthesizing portions of the selected piece of music.

12. The playback device of claim 11 wherein the user-specified playback parameter is a tempo for the selected piece of music.

13. The playback device of claim 11 wherein the user-specified playback parameter is a key for the selected piece of music.

14. The playback device of claim 11 wherein the user-specified playback parameter is a playback duration for the selected piece of music.

15. The playback device of claim 11 wherein the user-specified playback parameter is a verse-shuffle mode of operation for the selected piece of music, in which the sequencer repeatedly randomly selects a verse from a plurality of verses of the selected piece of music for playback with a chorus of the selected piece of music.

16. The playback device of claim 11 further including a solid state data storage device for storing the audio information in the structured audio format.

17. The playback device of claim 16 wherein the data storage device is a data storage cartridge, and the playback device further includes a slot for accepting the data storage cartridge.

18. The playback device of claim 17 wherein the data storage cartridge is a PCMCIA card.

19. The playback device of claim 11 further including a network connection through which the processor retrieves the audio information.

20. An interactive music playback device comprising:

a processor for arranging audio information corresponding to a selected piece of music into a playback sequence in accordance with at least one user-specified playback parameter, wherein the audio information is in a structured audio format including one or more gesture files; and at least one synthesizer for synthesizing portions of the selected piece of music from the playback sequence.

21. An interactive music playback device comprising:

means for arranging audio information corresponding to a selected piece of music into a playback sequence in accordance with at least one user-specified playback parameter, wherein the audio information is in a structured audio format including one or more gesture files; and means for synthesizing portions of the selected piece of music from the playback sequence.

22. An interactive music playback device comprising:

a housing having a receptacle for accepting a data storage device;

a processor arranged within the housing, wherein the processor is operative (i) to retrieve from the data storage device audio information in a structured audio format including one or more gesture files and corresponding to a selected piece of music, and (ii) to arrange the retrieved audio information in a playback sequence in accordance with at least one user-specified playback parameter; and a digital signal processing device arranged within the housing and coupled to the processor, the digital signal processing device receiving at least a portion of the sequence of audio information from the sequencer, and synthesizing portions of the selected piece of music.

23. The playback device of claim 22 further including a display providing an indication of a current status of the at least one user-specified playback parameter.

24. A method for interactive music playback, the method comprising the steps of:

arranging audio information corresponding to a selected piece of music into a playback sequence in accordance with at least one user-specified playback parameter, wherein the audio information is in a structured audio format including one or more gesture files; and synthesizing portions of the selected piece of music from the playback sequence.

25. The method of claim 24 wherein the user-specified playback parameter is a tempo for the selected piece of music.

26. The method of claim 24 wherein the user-specified playback parameter is a key for the selected piece of music.

27. The method of claim 24 wherein the user-specified playback parameter is a playback duration for the selected piece of music.

28. The method of claim 24 wherein the user-specified playback parameter is a verse-shuffle mode of operation for the selected piece of music, in which the sequencer repeatedly randomly selects a verse from a plurality of verses of the selected piece of music for playback with a chorus of the selected piece of music.

29. The method of claim 24 fuirther including the step of altering a characteristic of the playback sequence based on a measure generated by an environmental sensor.

30. The method of claim 24 further including the step of retrieving the audio information from a solid state data storage device.

31. The method of claim 24 further including the step of retrieving the audio information from a network via a network connection.

32. An interactive music playback device comprising:

a processor operative to arrange audio information corresponding to a selected piece of music, wherein the audio information is stored in a structured audio format including one or more gesture files, in a playback sequence in accordance with a user-specified verse-shuffle mode of operation in which the processor repeatedly randomly selects a verse from a plurality of verses of the selected piece of music for playback with a chorus of the selected piece of music; and at least one synthesizer coupled to the processor for synthesizing from the playback sequence portions of the selected piece of music.

33. An interactive music playback device comprising:

a sequencer for processing audio information corresponding to a selected piece of music, wherein the sequencer arranges the audio information in a playback sequence in accordance with at least one user-specified playback parameter;

a voice synthesizer having an input for receiving at least a portion of the sequence of audio information from the sequencer, wherein the voice synthesizer processes the received portion of the sequence to generate a vocal portion of the selected piece of music;

an instrument synthesizer having an input for receiving at least a portion of the sequence of audio information from the sequencer, wherein the instrument synthesizer processes the received portion of the sequence to generate an instrumental portion of the selected piece of music; and at least one environmental sensor having an output coupled to at least one of the sequencer and the instrument synthesizer, wherein a characteristic of the playback sequence is varied based on a measure generated by the environmental sensor.

34. An interactive music playback device comprising:

a processor operative (i) to retrieve audio information corresponding to a selected piece of music, and (ii) to arrange the audio information in a playback sequence in accordance with at least one user-specified playback parameter;

a digital signal processing device coupled to the processor, the digital signal processing device receiving at least a portion of the sequence of audio information from the sequencer, and synthesizing portions of the selected piece of music; and at least one environmental sensor having an output coupled to at least one of the processor and the digital signal processing device, such that a characteristic of the playback sequence is varied based on a measure generated by the environmental sensor.

35. An interactive music playback device comprising:

a processor for arranging audio information corresponding to a selected piece of music into a playback sequence in accordance with at least one user-specified playback parameter;

at least one synthesizer for synthesizing portions of the selected piece of music from the playback sequence; and at least one environmental sensor having an output coupled to at least one of the processor and the digital signal processing device, such that a characteristic of the playback sequence is varied based on a measure generated by the environmental sensor.

36. A method for interactive music playback, the method comprising the steps of:

arranging audio information corresponding to a selected piece of music into a playback sequence in accordance with at least one user-specified playback parameter;

synthesizing portions of the selected piece of music from the playback sequence; and altering a characteristic of the playback sequence based on a measure generated by an environmental sensor.

* * * * *